US007600698B2

(12) United States Patent
Treitz

(10) Patent No.: US 7,600,698 B2
(45) Date of Patent: Oct. 13, 2009

(54) CLEANING HEAD AND SURFACE CLEANING DEVICE COMPRISING SAID TYPE OF CLEANING HEAD

(75) Inventor: Felix Treitz, Berglen (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 116 days.

(21) Appl. No.: 11/820,730

(22) Filed: Jun. 19, 2007

(65) Prior Publication Data

US 2008/0006715 A1 Jan. 10, 2008

Related U.S. Application Data

(63) Continuation of application No. PCT/EP2005/012363, filed on Nov. 18, 2005.

(30) Foreign Application Priority Data

Dec. 23, 2004 (DE) ..... 10 2004 063 202

(51) Int. Cl.
*B05B 3/00* (2006.01)
*B05B 3/02* (2006.01)
*B05B 1/28* (2006.01)

(52) U.S. Cl. ..... 239/66; 239/97; 239/263.1; 239/288; 239/754; 134/173; 134/198

(58) Field of Classification Search ..... 239/66, 239/93, 97–100, 225.1, 231, 263.1, 264, 239/525, 532, 581.1, 754, 288–288.5; 134/172–176, 134/178, 179, 198, 199; 15/320–322
See application file for complete search history.

(56) References Cited

U.S. PATENT DOCUMENTS 4,014,067 A 3/1977 Bates
4,107,816 A * 8/1978 Matthews ..... 15/320
4,191,590 A 3/1980 Sundheim
4,339,840 A 7/1982 Monson
4,690,325 A * 9/1987 Pacht ..... 239/124
4,792,096 A 12/1988 Gregory
5,312,044 A * 5/1994 Eaton ..... 239/225.1
5,456,412 A * 10/1995 Agee ..... 239/104
5,636,402 A 6/1997 Kubo et al.
6,012,645 A 1/2000 Poppitz
6,183,212 B1 2/2001 Djordjevic

FOREIGN PATENT DOCUMENTS

DE 23 50 898 4/1974
DE 103 13 396 10/2003

(Continued)

*Primary Examiner*—Darren W Gorman
(74) *Attorney, Agent, or Firm*—Lipsitz & McAllister, LLC

(57) ABSTRACT

The invention relates to a cleaning head for enabling pressurized cleaning liquid to act upon a surface to be cleaned, comprising at least one spray arm which is rotatably mounted about an axis of rotation and on which is mounted at least one nozzle which can be fed with cleaning liquid by a pressure pump. The invention also relates to a surface cleaning device comprising said type of cleaning head. In order to further develop the surface cleaning device and the cleaning head in such a way that the surface cleaning device can be handled more easily, the invention proposes that the pressure pump is integrated into the cleaning head.

31 Claims, 5 Drawing Sheets

FOREIGN PATENT DOCUMENTS

| | | |
|---|---|---|
| DE | 10 2004 013 057 | 7/2005 |
| EP | 1 098 089 | 5/2001 |
| EP | 1 216 761 | 6/2002 |
| EP | 1 262 246 | 12/2002 |
| EP | 1 413 749 | 4/2004 |

* cited by examiner

CLEANING HEAD AND SURFACE CLEANING DEVICE COMPRISING SAID TYPE OF CLEANING HEAD

This application is a continuation of international application number PCT/EP2005/012363 filed on Nov. 18, 2005.

The present disclosure relates to the subject matter disclosed in international application number PCT/EP2005/012363 of Nov. 18, 2005 and German application number 10 2004 063 202.2 of Dec. 23, 2004, which are incorporated herein by reference in their entirety and for all purposes.

BACKGROUND OF THE INVENTION

The invention relates to a cleaning head for enabling pressurized cleaning liquid to act upon a surface to be cleaned, comprising at least one spray arm which is rotatably mounted about an axis of rotation and on which is mounted at least one nozzle which can be fed with cleaning liquid by a pressure pump.

The invention also relates to a surface cleaning device comprising said type of cleaning head.

A floor surface, for example, can be effectively cleaned by means of surface cleaning devices. To this end, a pressure pump can be connected to the cleaning head, and pressurized cleaning liquid can be fed to the least one nozzle with the aid of said pressure pump. The nozzle is mounted on a spray arm which is rotatably mounted about an axis of rotation. As a result, the nozzle can execute a rotary movement together with the spray arm when cleaning liquid is discharged, so that the surface to be cleaned can be acted upon by a liquid jet which circulates on a circular path. Effective cleaning can be achieved as a result; however it is desirable to simplify handling of the surface cleaning device.

SUMMARY OF THE INVENTION

It is therefore an object of the present invention to further develop a cleaning head of the type mentioned in the introduction in such a way that said cleaning head permits simplified handling of a surface cleaning device comprising said type of cleaning head.

In the case of a cleaning head of this generic type, this object is achieved, according to the invention, by the pressure pump being integrated into the cleaning head.

A configuration of this type has the advantage that a stationary pressure pump which is in flow connection with the cleaning head by means of a pressure hose can be dispensed with. Handling of a surface cleaning device comprising this type of cleaning head is therefore considerably simplified.

It is advantageous if the cleaning head has a rotor housing which surrounds an eccentric and can rotate about the axis of rotation with respect to the eccentric, at least one spray arm being fixed on the rotor housing and a delivery piston being displaceably mounted in the spray arm, it being possible to drive the said delivery piston to and fro within the spray arm in accordance with the revolving movement of the rotor housing about the eccentric, the delivery piston entering into a cylinder space which is in flow connection with the least one nozzle and which can be fed with cleaning liquid. A configuration of this type permits a particularly compact construction of the cleaning head. It forms, as a combination of at least one spray arm which can rotate about an axis of rotation and on which least one nozzle is mounted and a pressure pump, a unit which can be directed, for example, along a floor surface by the user. The cleaning head can also be used to clean the inside of a container, for example a liquid tank, with said cleaning head needing to be flow-connected to a source of cleaning liquid only via a low-pressure hose. Low-pressure hoses of this type have a greater degree of flexibility than high-pressure hoses as are usually used to connect known cleaning heads to a stationary pressure pump.

During the revolving movement of the rotor housing, the piston which is displaceably mounted in the spray arm is driven to and fro on account of the eccentricity of the eccentric, so that cleaning liquid flows into the cylinder space during an intake stroke of the delivery piston and the liquid from the cylinder can be pressurized and discharged via the nozzle during a pressure stroke. In this case, the eccentric is held such that it cannot move, whereas the rotor housing executes a rotary movement together with the at least one spray arm which is fixed to it. The rotary movement of the rotor housing and the spray arm therefore serves not only to produce a liquid jet which circulates on a circular path but it additionally serves to drive the delivery piston which is displaceably mounted in the spray arm.

It is advantageous if the cleaning liquid can be fed to the cylinder space through the eccentric and the piston. This permits a particularly compact configuration of the cleaning head. In this case, the eccentric not only takes over the function of a cam disk for controlling the movement of the delivery piston but it additionally forms a channel for feeding the cleaning liquid into the cylinder space.

In a particularly preferred embodiment, the eccentric comprises a radially extending flow channel which extends only over a partial region of the eccentric in the circumferential direction of the eccentric. Feed of cleaning liquid to the cylinder space takes place through the piston via the flow channel in the eccentric. During the revolving movement of the rotor housing with the at least one spray arm, the cylinder space is fed with cleaning liquid in a non-uniform manner, specifically only when there is a flow connection between the cylinder space and the flow channel. This flow connection is established only along a partial region of the circumference of the eccentric, whereas the flow connection between flow channel and cylinder space is interrupted in the rest of the circumferential region. A configuration of this type is particularly advantageous when the delivery piston effects an intake stroke when there is a flow connection between flow channel and cylinder space, and effects a pressure stroke when the flow connection between cylinder space and flow channel is interrupted. Additional control valves for the pressure pump can therefore be dispensed with.

It is advantageous if the flow channel extends over an angular range of at least 90° in the circumferential direction of the eccentric.

In a particularly preferred embodiment, it is provided that the flow channel extends over an angular range of more than 180° in the circumferential direction of the eccentric; in particular it may be provided that the flow channel extends over an angular range of approximately 220° in the circumferential direction of the eccentric. A configuration of this type has the advantage that the flow connection between flow channel and cylinder space is present not only when the piston carries out an intake stroke for introducing cleaning liquid into the cylinder space but also during part of its pressure stroke. As a result, discharge of pressurized cleaning liquid via the nozzle can be restricted to an angular range of less than 180°, in particular an angular range of approximately 140°. A configuration of this type is particularly advantageous when the cleaning head comprises a plurality of spray arms which are each fixed on the revolving rotor housing and on which in each case at least one nozzle is mounted. Cleaning liquid can be discharged via the nozzles in succession by means of the flow connection between flow channel and respective cylinder space which exists only over a partial region of the circumference of the eccentric. As a result of suitable orientation of the nozzles, a jet of cleaning liquid can act upon a surface to be cleaned in a strip-like manner, it being possible to keep the distance between the respective nozzle discharging cleaning liquid and the surface to be cleaned very low. A concentrated jet of cleaning liquid can therefore be directed onto the surface.

In a preferred embodiment, feed of cleaning liquid to the eccentric takes place via a hollow shaft on which the eccentric is held in a rotationally fixed manner. The hollow shaft serves firstly to support the eccentric and secondly forms a feed line via which the cleaning liquid can be fed to the eccentric.

The to and fro movement of the delivery piston which is displaceably mounted in the spray arm can be achieved by that end of said delivery piston which is remote from the cylinder space engaging directly against the eccentric. However, this leads to a not inconsiderable frictional force between delivery piston and eccentric. It is therefore advantageous if the delivery piston is mounted on a sliding shoe which engages against the outer wall of the eccentric. This permits the sliding shoe and the delivery piston to be optimally matched to the respectively prevailing requirements; in particular, the shape of the sliding shoe can be adapted to the shape of the eccentric and the lowest possible degree of friction between eccentric and sliding shoe can be achieved by suitable material selection.

The sliding shoe preferably has a through-hole via which the flow channel of the eccentric can be brought into flow-connection with a cut-out region in the piston. Feed of cleaning liquid can therefore take place through the eccentric and the sliding shoe to the delivery piston, and from said delivery piston to the cylinder space via the cut-out region in said delivery piston. The cut-out region in the piston is preferably configured as a longitudinal bore which is directed through the piston in the longitudinal direction of said piston.

It is advantageous if the delivery piston and the sliding shoe are pivotable in relation to one another. This has the advantage that, when the radial orientation of the delivery piston in relation to the axis of rotation of the rotor housing remains the same, the sliding shoe can follow the eccentric circumferential surface of the eccentric, without this leading to the piston or the sliding shoe tilting.

Provision may be made, for example, for the sliding shoe and the delivery piston to engage against one another by means of a spheroidal recess and a spheroidal projection which enters into the recess. The recess and the corresponding projection permit a relative pivoting movement of the two parts while maintaining surface-to-surface contact.

Provision may be made for the sliding shoe to have the spheroidal projection on its side which faces the delivery piston and for the delivery piston to accommodate the projection with a spheroidal recess which is disposed at its rear end. As an alternative, provision may be made for that end region of the piston which faces the sliding shoe to form the spheroidal projection which enters a spheroidal recess in the sliding shoe.

It has proven particularly advantageous when the sliding shoe has a depression in the region of its abutment surface which engages against the eccentric, and the through-hole of the sliding shoe connects with said depression in the direction of the delivery piston. During an intake stroke, a pressure is generated within the cylinder space by the delivery piston, it being possible for this pressure to propagate through the cut-out region in the piston and the through-hole in the sliding shoe as far as the depression in the sliding shoe. An overpressure is therefore produced within the abutment region of the sliding shoe on the eccentric, this overpressure considerably reducing the frictional force between eccentric and sliding shoe. Outside the region of the depression, the overpressure in the abutment region of the sliding shoe on the eccentric drops in a substantially linear manner.

In order to produce the to and fro movement of the delivery piston, a structurally particularly simple configuration provides for the delivery piston to be preloaded in the direction of the eccentric by means of a return spring.

It is advantageous here if the return spring is disposed within the cylinder space.

The return spring can, for example, be clamped in between the piston and a nozzle holder on which the least one nozzle is mounted.

In order to seal off the cylinder space, it is advantageous if the piston is surrounded by at least one sealing ring in the circumferential direction.

The sealing ring is advantageously configured as a piston ring. It has been found that this permits particularly low-friction mounting of the delivery piston in the spray arm while at the same time ensuring a high degree of sealing between delivery pump and the wall of the spray arm surrounding it The sealing ring, in particular the piston ring, is preferably produced from a plastics material based on PEEK, that is to say based on a polyetheretherketone material.

In a preferred embodiment, the piston is produced from a light metal, for example an aluminum alloy, or from a plastics material.

It is advantageous if flow-guide elements, for example cross-pieces oriented in the form of a cross, are disposed within the longitudinal bore in the piston, with the aid of which flow-guide elements the flow can be oriented within the delivery piston.

The rotor housing is preferably mounted on a shaft and is sealed off from said shaft by means of at least one sealing ring. It is advantageous here if the least one sealing ring is configured as a piston ring.

The rotor housing is preferably driven in rotation by means of a drive motor which can be coupled to the rotor housing by means of gear elements. For example, an angular gear unit or else a belt drive can be used.

It is particularly advantageous if the housing is fixedly connected to the rotor of an external-rotor motor. This permits a particularly compact construction of the cleaning head with an electric drive connected.

It is advantageous if the cleaning head has a splash-protection hood in which the rotor housing is rotatably mounted and which has a liquid discharge opening. This type of configuration of the cleaning head is particularly advantageous when used in a surface cleaning device for cleaning floors, since the splash-protection hood ensures in a structurally simple manner that the at least one nozzle, which rotates together with the rotor housing, enables cleaning liquid to act upon the surface to be cleaned only in the region of the liquid discharge opening.

A shaft is preferably held in rotationally fixed manner on the splash-protection hood, and the rotor housing is rotatably mounted on said shaft.

As already mentioned, the cleaning head described above is used particularly in a surface cleaning device. In this case, it is provided in a preferred embodiment that the surface cleaning device comprises a handle on which the cleaning head is mounted. A configuration of this type has the advantage that the user can move the cleaning head along a surface to be cleaned with the aid of the handle, it being possible for said user to assume an upright position. The surface cleaning device is therefore of upright form like an upright vacuum cleaner.

It is advantageous if the surface cleaning device has support elements for supporting the surface cleaning device on the surface to be cleaned. The user is thus relieved of the weight of the surface cleaning device, in particular of the weight of the cleaning head. This permits particularly simple handling of the surface cleaning device.

The cleaning head is preferably disposed in the region of that end of the handle which faces the surface to be cleaned, so that the center of gravity of the surface cleaning device is adjacent to the surface to be cleaned.

The surface cleaning device preferably comprises a manually operated switching member for controlling the liquid discharge from the cleaning head. It is advantageous here if the switching member is disposed in the region of that end of the handle which is remote from the cleaning head. As a result, it is possible to further simplify handling of the surface cleaning device.

A particularly compact construction of a surface cleaning device according to the invention can be achieved by the handle forming a feed line for cleaning agent, it being possible for the feed line to be connected to a supply hose. In this case, provision may be made for a connection fitting to be disposed in the region of that end of the handle which is remote from the cleaning head, for the purpose of connecting the supply hose.

The following description of a preferred embodiment of a cleaning head according to the invention and of a surface cleaning device according to the invention serves for further explanation in conjunction with the drawings.

DETAILED DESCRIPTION OF THE INVENTION

Figure 1:
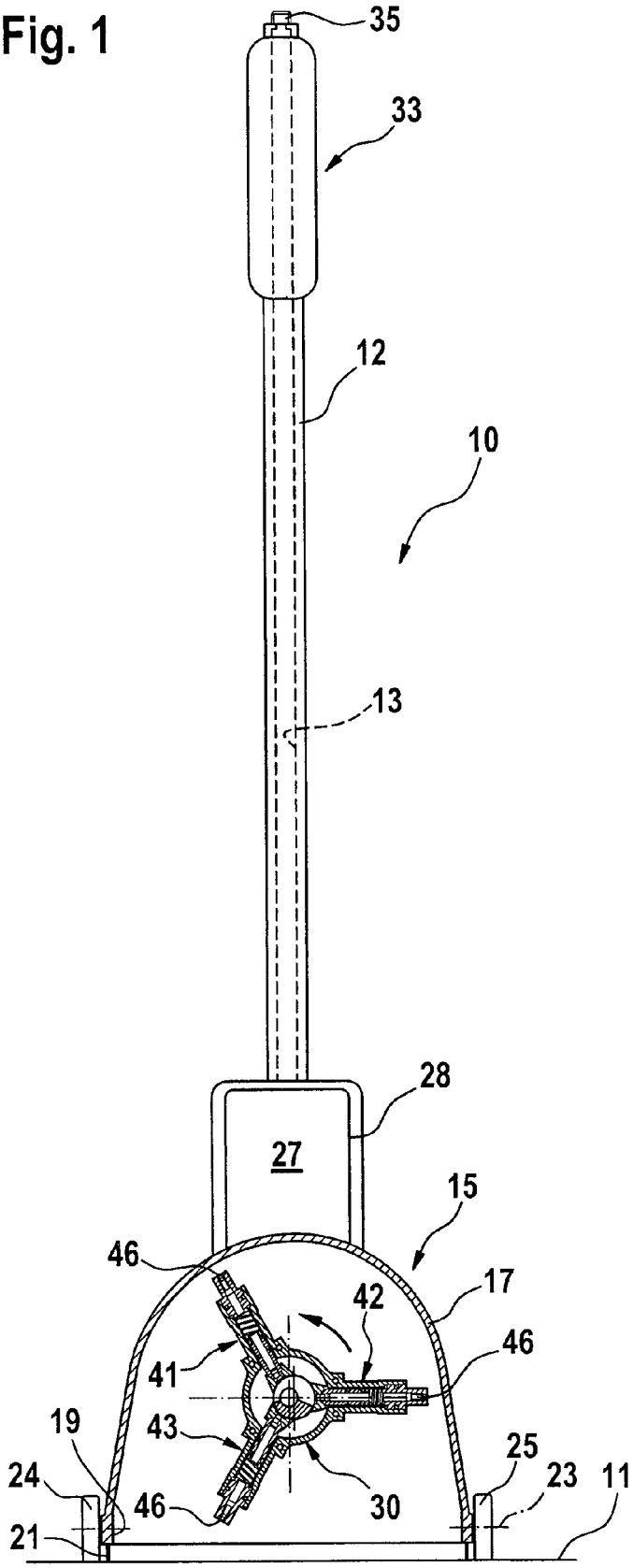
FIG. 1: shows a schematic, partially sectioned front view of a surface cleaning device according to the invention.
Figure 3:
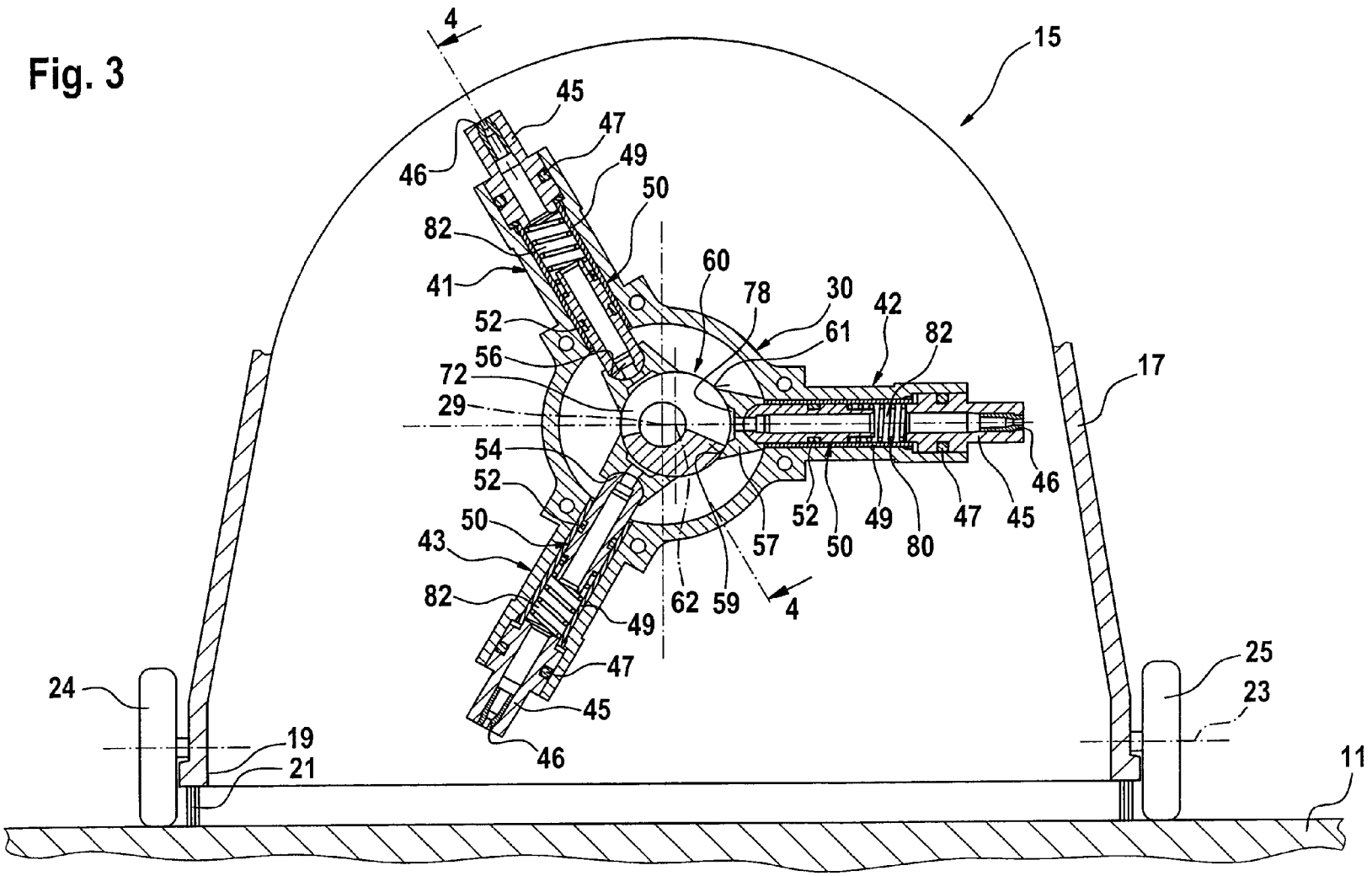
FIG. 3: shows a schematic, partially sectioned front view of an inventive cleaning head of the surface cleaning device from FIG. 1.
Figure 4:
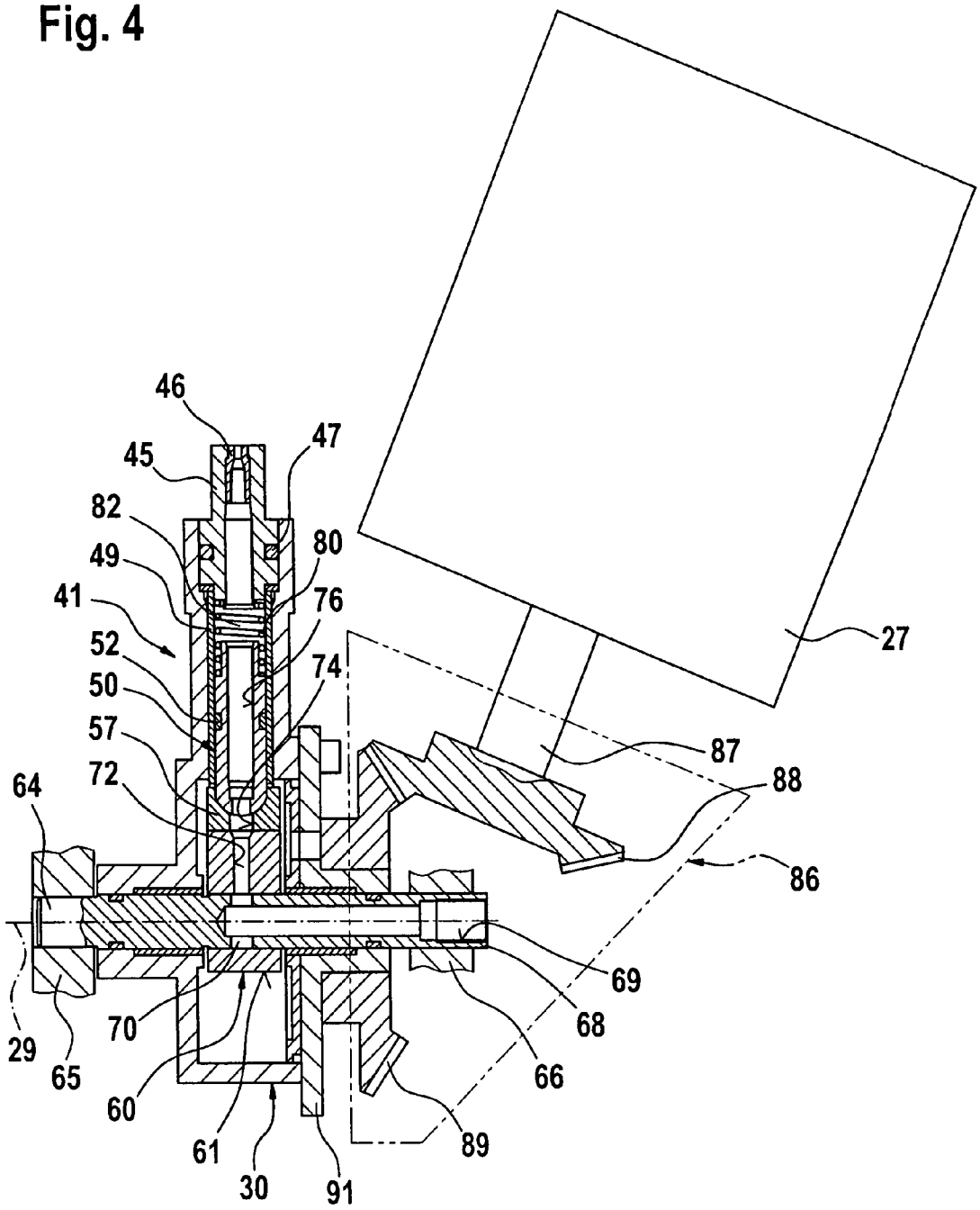
FIG. 4: shows a schematic partial sectional view along line 4-4 from FIG. 3.

In FIG. 1, there is schematically illustrated a surface cleaning device 10 according to the invention which is in the form of a manually controlled, upright-form pressurized-water cleaning device and which can be moved along a surface 11 by the user in order to clean said surface. Said surface cleaning device comprises a handle 12, which is configured in the manner of a tube, and a supply line 13 designed for cleaning liquid, preferably water, which can be fed to a cleaning head 15 which is fixed to the lower end of the handle 12, which end faces the surface 11 to be cleaned. The cleaning head 15, which is explained in greater detail below with reference to FIGS. 3 and 4, has a splash-protection hood 17 which defines a liquid discharge opening 19 facing the surface 11, which liquid discharge opening is surrounded in the circumferential direction by a splash-protection element in the form of a strip 21 of bristles which makes contact with the surface 11. On the outside, two support rollers 24, 25 which can rotate freely about a common axis of rotation 23 are mounted adjacent to the splash-protection hood 17 of the liquid discharge opening 19, it being possible to use said support rollers to support the surface cleaning device 10 on the surface 11 to be cleaned and to move said surface cleaning device along said surface.

An electric motor 27 is fixed to the handle 12 above the splash-protection hood 17, it being possible for cleaning liquid to flow around the housing 28 of said electric motor for cooling purposes and said electric motor being operatively connected to a rotor housing 30 which is mounted in the splash-protection hood 17 such that it can rotate about an axis of rotation 29.

At its upper end which is remote from the cleaning head 15, the handle 12 is provided with a switching member 33 which can be manually operated by the user and has a pivoting lever 34 and a connection fitting 35.

Figure 2:
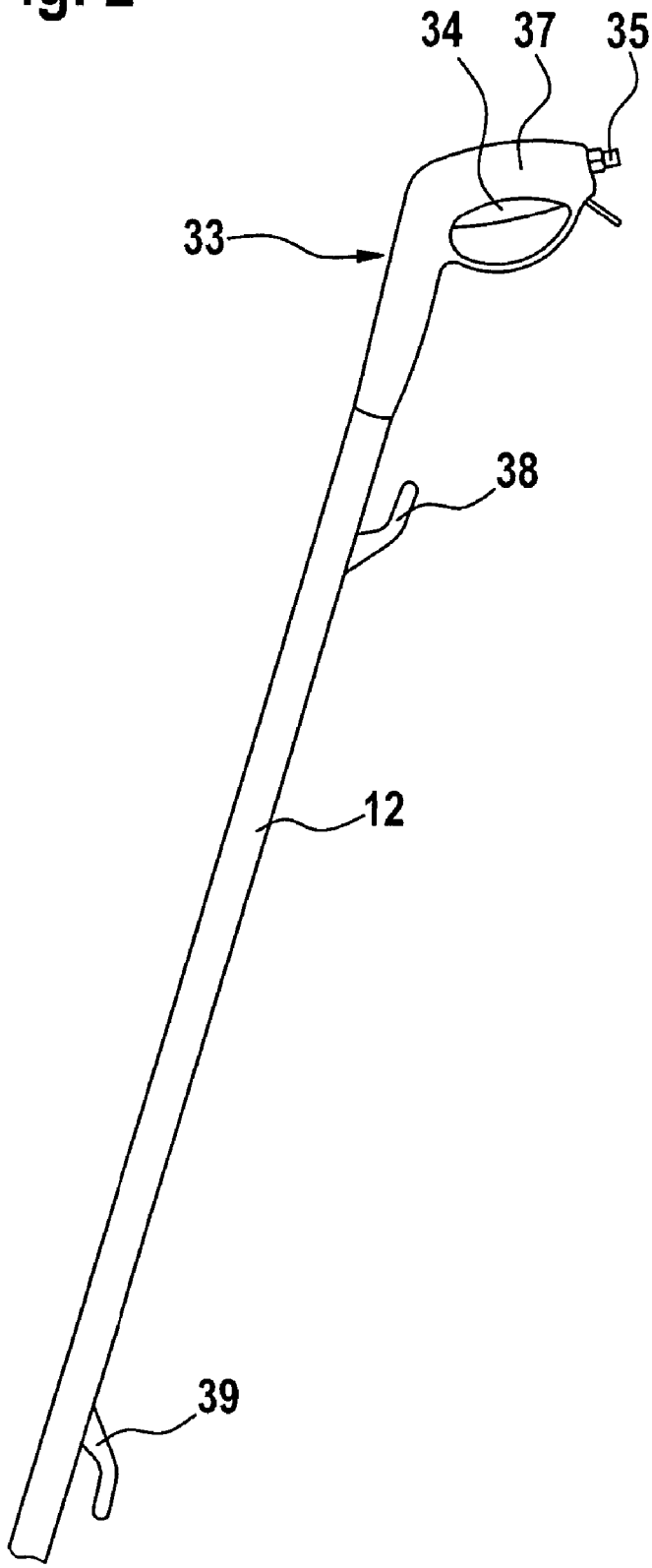
FIG. 2: shows a side view of a detail of the surface cleaning device from FIG. 1.

As is clear particularly from FIG. 2, the switching member 33 is configured in the manner of a pistol and comprises a hand grip 37 which can be grasped by the user and on which the pivoting lever 34 is pivotably mounted. The switching member forms a shut-off valve with which the flow of cleaning liquid can be selectively released and interrupted by the user.

The connection fitting 35 is fixed to that end of the switching member 33 which is remote from the handle 12 and serves for connection of a low-pressure supply hose via which the cleaning liquid can be fed to the surface cleaning device 10.

Two hook-like holders 38, 39 are fixed to the handle 12 at a distance from one another, and an electrical supply cable for the electric motor 27 can be wound around said hook-like holders when the surface cleaning device 10 is not in use.

Figure 5:
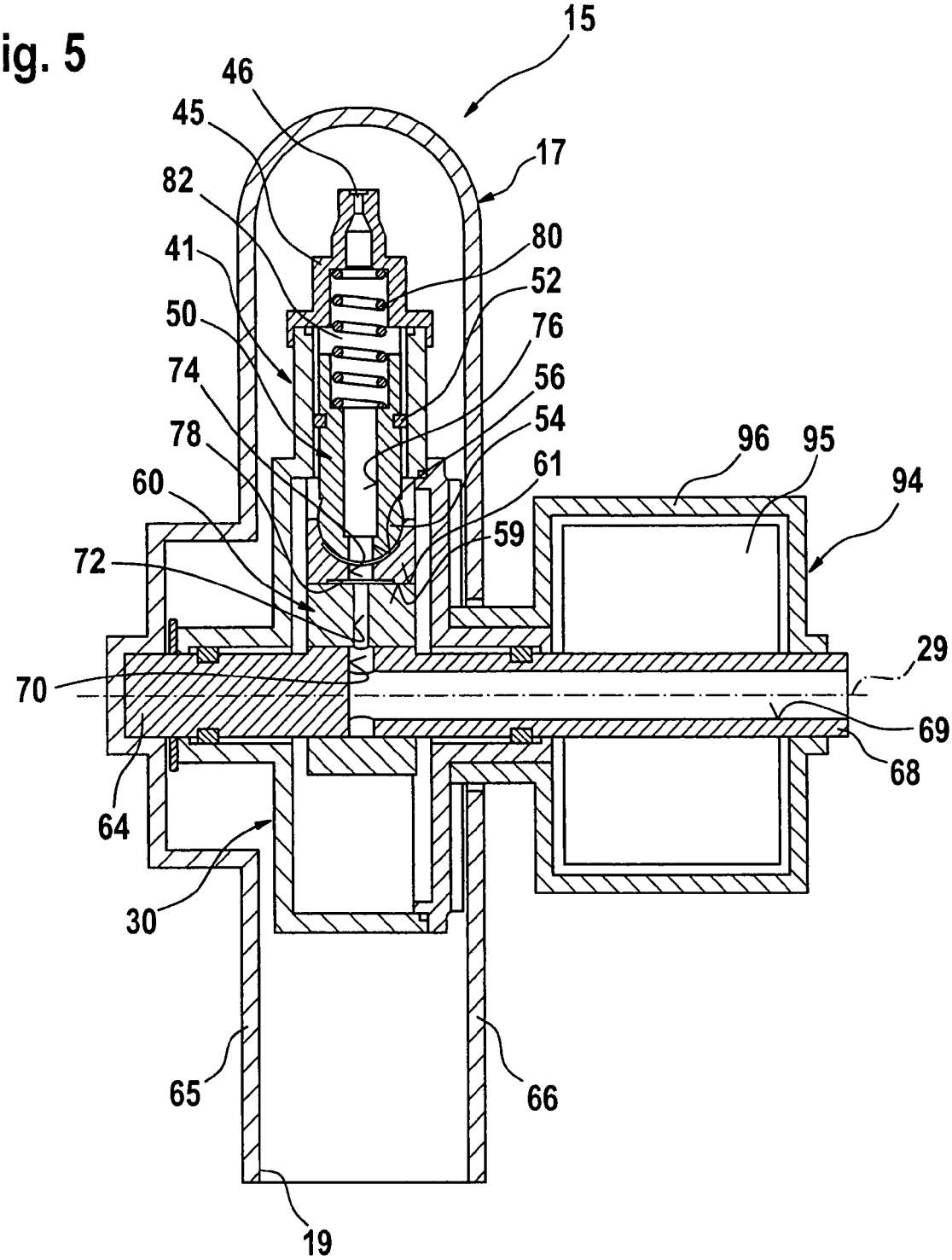
FIG. 5: shows a schematic partial sectional view which corresponds to FIG. 4 of an alternative embodiment of a cleaning head according to the invention.

The cleaning head 15, whose field of use is not restricted to the upright-form surface cleaning device 10 but which is explained for illustration purposes using the example of the surface cleaning device 10, has three hollow-cylindrical spray arms 41, 42, 43 which are fixed to the rotor housing 30 at the same angular distance from one another and are in each case radially oriented with respect to the axis of rotation 29. At their free ends, the spray arms 41, 42 and 43 each have a sleeve-like nozzle holder 45 which, in the exemplary embodiment of the cleaning head 15 illustrated in FIGS. 1 to 4, is inserted into the spray arm 41, 42 or 43 and secured using transverse pins 47, and, in the exemplary embodiment according to FIG. 5, is pushed onto the spray arm 41, 42 or 43 and with an end section projects beyond the spray arm. The nozzle holder 45 accommodates a nozzle 46.

With the exception of the region of the nozzle holder 45, the spray arms 41, 42 and 43 of the embodiment illustrated in FIGS. 1 to 4 are each lined by a sliding sleeve 49 which accommodates a delivery piston 50 which can be moved in the longitudinal direction of the respective spray arm 41, 42, 43 and is surrounded in the circumferential direction by a piston ring 52 in order to seal off the delivery piston 50 from the sliding sleeve 49. In the alternative configuration illustrated in FIG. 5, the delivery piston 50 rests directly against the inner wall of the respective spray arm 41, 42 or 43 by means of the piston ring 52.

That end region of the delivery piston 50 which is remote from the nozzle 46 is configured in the form of a spheroidal projection 54 which engages surface-to-surface against a spheroidal recess 56 in a sliding shoe 57. An abutment surface 59 of the sliding shoe 57, which abutment surface faces away from the delivery piston 50, engages against a non-rotatable eccentric 60 which is surrounded by the rotor housing 30. By rotating the rotor housing 30 and the spray arms 41, 42 and 43 which are fixed to it, the sliding shoes 57 can slide along the circumferential surface 61 of the eccentric 60. Said eccentric is configured in a circular cylindrical form, its center axis 62 being disposed offset in relation to the axis of rotation 29 of the rotor housing 30.

The eccentric 60 is held in a rotationally fixed manner on a hollow shaft 64 which is held in a rotationally fixed manner on an end wall 65 and a rear wall 66 of the splash-protection hood 17, the rear end 68 of said hollow shaft projecting outward beyond the rear wall 66. Starting from the rear end 68, an axial bore 69, with which there connects a through radial bore 70 in line with the eccentric 60, extends within the hollow shaft 64 as far as a location in line with the eccentric 60.

The radial bore 70 opens out into a radially extending flow channel 72 in the eccentric 60. The flow channel 72 extends in the circumferential direction of the eccentric 60, preferably over an angular range of more than 180°; in the illustrated embodiment, said flow channel extends over an angular range of approximately 220°. It opens out into the circumferential surface 61 and forms a flow connection between the interior of the hollow shaft 64 and a through-hole 74 in the sliding shoes 57, with which through-hole 74 there connects in the direction of the respective nozzle 46 a longitudinal bore 76 in the delivery piston 50, which piston is displaceably mounted in the respective spray arm 41, 42 or 43.

In the region of their abutment surfaces 59, the sliding shoes 57 each have a depression 78, with which there connects in the direction of the delivery piston 50 the through-hole 74.

The delivery pistons 50 are acted upon by an elastic restoring force in the direction of the respective sliding shoe 57 by means of a return spring 80, so that the sliding shoe 57 is pressed against the circumferential surface 61 of the eccentric 60. The return spring 80 is clamped in between the respective delivery piston 50 and the nozzle holder 45. Level with the return spring 80, the spray arms 41, 42 and 43 define a cylinder space 82 in the region between the respective delivery piston 50 and the nozzle holder 45, and the longitudinal bore 76 in the delivery piston 50 opens out into said cylinder space and said cylinder space is flow-connected to the respective nozzle 46 by means of the sleeve-like nozzle holder 45.

The cylinder spaces 82 in the spray arms 41, 42 and 43 can be fed with cleaning liquid via the hollow shaft 64, the eccentric 60, the sliding shoes 57 and the delivery piston 50. If the rotor housing 30 is rotated about the axis of rotation 29, the sliding shoes 57 slide along the circumferential surface 61 of the eccentric 60 and the delivery pistons 50 which are preloaded in a spring-elastic manner in the direction of the eccentric 60 execute a to and fro movement within the respective spray arm 41, 42 or 43 on account of the arrangement of the eccentric 60 in an eccentric manner in relation to the axis of rotation 29, so that cleaning liquid is placed under pressure within the cylinder space 82 and can then be discharged via the nozzle 46. Feed of cleaning liquid to the cylinder space 82 during a rotary movement of the rotor housing 30 takes place only along the partial region of the circumference of the eccentric 60 into which the flow channel 72 opens out, while the flow connection between the hollow shaft 64 and the cylinder space 82 is interrupted in the circumferential region which is not covered by the flow channel 72. The flow channel 72 is disposed in such a way that the delivery pistons 50 execute a reciprocating movement in the direction of the respective nozzle 46 in the circumferential region of the eccentric 60 which is not covered by the flow channel 72, the nozzle 46 facing the liquid discharge opening 19 and therefore the surface 11 to be cleaned. Since the flow channel 72 extends over an angular range of 220° in the circumferential direction of the eccentric 60, whereas the entire reciprocating movement of the delivery piston takes place over an angular range of 180°, the flow connection between the hollow shaft 64 and the cylinder space 82 is again released even during the reciprocating movement of the respective delivery piston 50. The result of this is that pressure equalization between the cylinder space 82 and the hollow shaft 64 takes place even during the reciprocating movement of the delivery piston 50, so that the discharge of pressurized cleaning liquid via the nozzle 46 is interrupted. This ensures that pressurized cleaning liquid is discharged via the nozzles 46 for all practical purposes only when said nozzles are facing the liquid discharge opening 19.

The surface to be cleaned can therefore be acted upon by cleaning liquid in a strip-like manner via the nozzles 46 in succession, the nozzle 46 which is discharging the cleaning liquid in each case being at a short distance from the surface 11, so that a concentrated jet of cleaning agent can be directed onto the surface 11.

Feed of cleaning liquid to the rear end 68 of the hollow shaft 64 starting from the supply line 13 takes place via a flexible connection line (not illustrated in the drawing) which is known per se and can be connected to the rear end 68.

The rotor housing 30 is rotated by the electric motor 27. Force transmission can take place, for example, with the aid of a gear mechanism 86 (schematically illustrated in FIG. 4) which is in the form of an angular gear and has a gearwheel 88 which is held in a rotationally fixed manner on a motor shaft 87 and meshes with a crown gear 89 which is held in a rotationally fixed manner on a base wall 91 of the rotor housing 30.

A belt drive which is known per se and is therefore not illustrated in the drawing can, for example, be used in place of the gear mechanism 86.

As illustrated in FIG. 5 as an alternative configuration of the cleaning head 15, the electric motor 27 can also be configured in the form of an external-rotor motor 94 with a stator 95 which is held in a rotationally fixed manner on the hollow shaft 64 and is surrounded by a rotor 96, the rotor 96 being held in a rotationally fixed manner on the base wall 91 of the rotor housing 30. This permits a particularly compact configuration, it being possible to dispense with the use of a gear unit.

The invention claimed is:

1. Cleaning head for enabling pressurized cleaning liquid to act upon a surface to be cleaned, comprising:

a rotor housing which surrounds an eccentric and can rotate about an axis of rotation with respect to the eccentric, a pressure pump integrated into said cleaning head, at least one spray arm which is rotatably mounted on the rotor housing for rotation about the axis of rotation, and at least one nozzle mounted on the at least one spray arm, said at least one nozzle being adapted to be fed with cleaning liquid by the pressure pump, the pressure pump comprising a delivery piston displaceably mounted in the at least one spray arm, it being possible to drive said delivery piston to and fro within the spray arm in accordance with the revolving movement of the rotor housing about the eccentric, the delivery piston entering into a cylinder space which is in flow connection with the least one nozzle and which can be fed with the cleaning liquid.

2. Cleaning head according to claim 1, wherein the cleaning liquid is fed to the cylinder space through the eccentric and the delivery piston.

3. Cleaning head according to claim 2, wherein the eccentric comprises a radially extending flow channel which extends only over a partial region of the eccentric in a circumferential direction of the eccentric.

4. Cleaning head according to claim 3, wherein the flow channel extends over an angular range of at least 90° in the circumferential direction of the eccentric.

5. Cleaning head according to claim 3, wherein the flow channel extends over an angular range of more than 180° in the circumferential direction of the eccentric.

6. Cleaning head according to claim 2, wherein the eccentric is held in a rotationally fixed manner on a hollow shaft via which the cleaning liquid can be fed to the eccentric.

7. Cleaning head according to claim 1, wherein the delivery piston is mounted in a sliding shoe which engages against a circumferential surface of the eccentric.

8. Cleaning head according to claim 7, wherein the sliding shoe has a through-hole via which a flow channel of the eccentric can be brought into flow-connection with a cut-out region in the delivery piston.

9. Cleaning head according to claim 8, wherein the cut-out region in the delivery piston is configured as a longitudinal bore.

10. Cleaning head according to claim 7, wherein the sliding shoe and the delivery piston engage against one another by means of a spheroidal recess and a spheroidal projection which enters into the recess.

11. Cleaning head according to claim 10, wherein an end region of the delivery piston which faces the sliding shoe forms the spheroidal projection which enters into a spheroidal recess in the sliding shoe.

12. Cleaning head according to claim 8, wherein the sliding shoe has a depression in a region of an abutment surface of the sliding shoe which engages against the eccentric, and the through-hole connects with said depression in the direction of the delivery piston.

13. Cleaning head according to claim 1, wherein the delivery piston is preloaded in a direction of the eccentric by means of a return spring.

14. Cleaning head according to claim 13, wherein the return spring is disposed in the cylinder space.

15. Cleaning head according to claim 13, wherein the return spring is clamped in between the delivery piston and a nozzle holder on which the least one nozzle is mounted.

16. Cleaning head according to claim 1, wherein the delivery piston is surrounded by at least one sealing ring in a circumferential direction.

17. Cleaning head according to claim 16, wherein the sealing ring is configured as a piston ring.

18. Cleaning head according to claim 16, wherein the sealing ring is produced from a plastics material based on PEEK.

19. Cleaning head according to claim 1, wherein the delivery piston is produced from a light metal or a plastics material.

20. Cleaning head according to claim 1, wherein the rotor housing is mounted on a shaft such that it can rotate and is sealed off from said shaft by means of at least one sealing ring.

21. Cleaning head according to claim 20, wherein the at least one sealing ring is configured as a piston ring.

22. Cleaning head according to claim 1, wherein the rotor housing is adapted to be coupled to a drive motor by means of gear elements.

23. Cleaning head according to claim 1, wherein the rotor housing is fixedly connected to a rotor of an external-rotor motor.

24. Cleaning head according to claim 1, wherein the cleaning head has a splash-protection hood in which the rotor housing is rotatably mounted and which has a liquid discharge opening.

25. Cleaning head according to claim 24, wherein a shaft is held in a rotationally fixed manner on the splash-protection hood, and the rotor housing is rotatably mounted on said shaft.

26. Surface cleaning device, comprising:

a cleaning head, said cleaning head comprising:

a rotor housing which surrounds an eccentric and can rotate about an axis of rotation with respect to the eccentric, a pressure pump integrated into said cleaning head, at least one spray arm which is rotatably mounted on the rotor housing for rotation about the axis of rotation, and at least one nozzle mounted on the at least one spray arm, said at least one nozzle being adapted to be fed with cleaning liquid by the pressure pump, the pressure pump comprising a delivery piston displaceably mounted in the at least one spray arm, it being possible to drive said delivery piston to and fro within the spray arm in accordance with the revolving movement of the rotor housing about the eccentric, the delivery piston entering into a cylinder space which is in flow connection with the least one nozzle and which can be fed with the cleaning liquid.

27. Surface cleaning device according to claim 26, wherein the surface cleaning device comprises a handle on which the cleaning head is mounted.

28. Surface cleaning device according to claim 26, wherein the surface cleaning device has support elements for supporting the surface cleaning device on a surface to be cleaned.

29. Surface cleaning device according to claim 26, further comprising a manually operated switching member for controlling the cleaning liquid discharge from the cleaning head.

30. Surface cleaning device according to claim 29, wherein the switching member is mounted on an end of a handle which is remote from the cleaning head.

31. Surface cleaning device according to claim 27, wherein the handle forms a feed line for cleaning agent, the feed line being adapted to be connected to a supply hose.

* * * * *